US005213535A

United States Patent [19]

Richens, Jr.

[11] Patent Number: 5,213,535

[45] Date of Patent: May 25, 1993

[54] SLALOM/TRICK WATER SKI WITH SIDE BY SIDE BINDING

[76] Inventor: David A. Richens, Jr., 23637 Meadcliff Pl., Diamond Bar, Calif. 91765

[21] Appl. No.: 712,525

[22] Filed: Jun. 10, 1991

[51] Int. Cl.[5] ..... A63C 5/03

[52] U.S. Cl. ..... 441/70; 441/68

[58] Field of Search ..... 441/68, 70, 76, 75, 441/74, 79; 272/16; 280/601, 602-609; D21/228-231

[56] References Cited

U.S. PATENT DOCUMENTS

| | | | |
|---|---|---|---|
| 3,216,031 | 11/1965 | Ingold, Jr. | 441/68 |
| 3,328,045 | 6/1967 | Davignon | 441/70 X |
| 4,028,760 | 6/1977 | Tarlton, Jr. | 441/70 |
| 4,296,511 | 10/1981 | Wright | 441/68 |
| 4,608,023 | 8/1986 | Williams | 441/68 |
| 4,629,435 | 12/1986 | Pitcairn | 441/68 |
| 4,871,337 | 10/1989 | Harris | 441/70 |
| 5,080,620 | 1/1992 | Reden | 441/68 |

*Primary Examiner*—Edwin L. Swinehart
*Attorney, Agent, or Firm*—Poms, Smith, Lande & Rose

[57] ABSTRACT

A water ski with a short and broad ski body and having a forebody, midbody, and tail rocker and a top and bottom surface. Affixed to the top surface is foot binding having a right and left boot. The right and left boot are mounted on the right and left side respectively of the longitudinal centerline of the ski body by means of a binding plate which is adjustable either forward or rearward on the ski body. Just behind the heel clamp of the binding assembly is the transverse center of the stabilizing fin. The fin blade protrudes through a slot in the ski body downward through the ski body. The fin is affixed to the top surface of the ski body by the fin fixing flange. The bottom surface of the ski body has a bevel along the entire perimeter and a concave tunnel that begins at the tail and ends at the forbody. Between the bevel and concave tunnel is a flat rail the is generally parallel to the top surface of the ski body. The ski is intended to perform as a trick ski because of its short length, light weight, and side by side binding configuration. It also is intended for use as a slalom ski due to its short length and therefore short turning radius and the mounting of the fin just behind the heel thereby requiring less leverage to initiate slalom turns. The ski also provides a stance very similar to that of snow skiing and therefor may be used to practice snow skiing during the off-season.

7 Claims, 3 Drawing Sheets

SLALOM/TRICK WATER SKI WITH SIDE BY SIDE BINDING

BACKGROUND

1. Field of Invention

This invention relates to water skis, and specifically to a unique length, shape, and profile of ski body and a configuration of binding, in which the skier's feet are side by side on the ski body for use as a slalom ski as well as a trick ski.

2. Description of Prior Art

Heretofore ski manufacturers have produced slalom and trick water skis as two separate and distinctly different types of skis. The Slalom ski being used in high speed turns and the trick ski being used for low speed turns, spins, wake tricks, and aerial moves.

Traditionally the slalom ski has been a narrow elongated shape with a fin at the tail and bindings mounted end to end at the mid-body of the ski. U.S. Pat. No. 4,795,386 to La Point and U.S. Pat. No. 4,608,023 to Williams (1984) show a typical modern day slalom ski. The greatly upturned fore-body portion of the slalom ski allows the ski to pass through water at high speed without spilling end over end. The fin keeps the rear or tail of the ski from slipping sideways. However this configuration is not very manuverable at low tricking speeds. Conversely, the modern trick ski with its very slightly upturned foreward end and lack of a stabilizing fin make it highly unstable at high speeds. U.S. Pat. No. 3,395,410 to Rutland shows a trick ski with a slightly upturned foreward end. As with the slalom ski, the trick ski has its bindings mounted one in front of the other along the longitudinal center line of the ski body.

In addition to the disadvantage of the traditional slalom and trick ski regarding using one ski for slalom and trick skiing (dual use), the binding configuration of trick and water skis has always been to mount the bindings toe to heel along the longitudinal centerline of the ski body in large part due tradition. This configuration along with a lack of innovation in the ski industry have provided a product with the following disadvantages:

A) Slalom skis are long and narrow with a fin at the rear which makes them less manuverable at low speeds.

B) Trick skis with their flat profile and lack of a fin are highly unstable at high boat speeds.

C) Traditional trick and slalom skis restrict the mounting of the bindings to toe to heel configuration.

D) Traditional slalom and trick skis are limited by design to either trick skiing or slalom skiing but not both.

OBJECTS AND ADVANTAGES

Accordingly, besides the disadvantages of the traditional water ski and the lack of innovation in the design of new water skis, several objects and advantages of the present invention are:

A) to provide a slalom water ski which is manuverable at slower boat speeds;

B) to provide a trick ski which is stable at higher boat speeds;

C) to provide a ski which will accomodate a side by side mounting of the binding.

D) to provide a new recreational and competitive class of skiing;

E) to provide a new style of skiing that will revolutionize the ski industry;

F) to provide a ski which can be used for both slalom and trick skiing.

Further objects and advantages are to provide a new form of water ski in order to permit unusual skiing techniques and enjoyment of the sport. Also, the side by side binding configuration and the unusual stance therein provide a ride similar to that of snow skiing which may provide for a means of practicing snow skiing techniques during the off season. Lastly, the highly unusual appearance and performance of the ski will provide a unique and valuable marketing advantage to the manufacturer who owns the patent.

Figure 1:
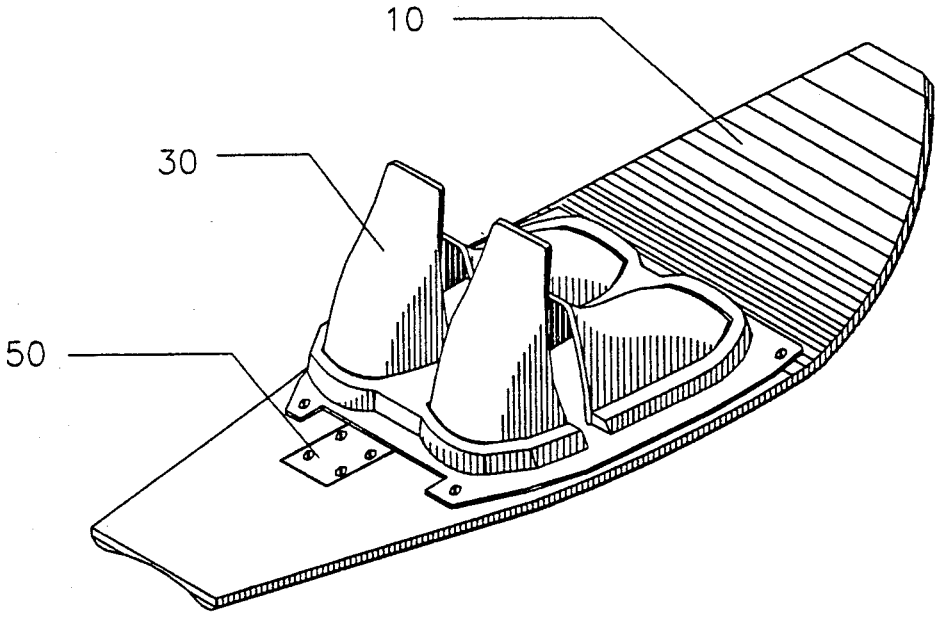
FIG. 1 is perspective view of the top of the ski in accordance with the invention.

| Reference Numerals In Drawings | |
|---|---|
| 10 | Ski body |
| 12 | Bevel |
| 14 | Concave tunnel |
| 16 | Rail |
| 18 | Tail section |
| 20 | Midbody |
| 22 | Forebody |
| 30 | Binding |
| 31 | Right Boot |
| 32 | Left boot |
| 33 | Binding plate |
| 34 | Arch clamp |
| 36 | Toe piece |
| 38 | Heel clamp |
| 40 | Heel cup |
| 42 | Adjustment screw |
| 44 | Plate adjustment slot |
| 50 | Fin fixing flange |
| 52 | Fin |

DESCRIPTION OF INVENTION

Figure 2:
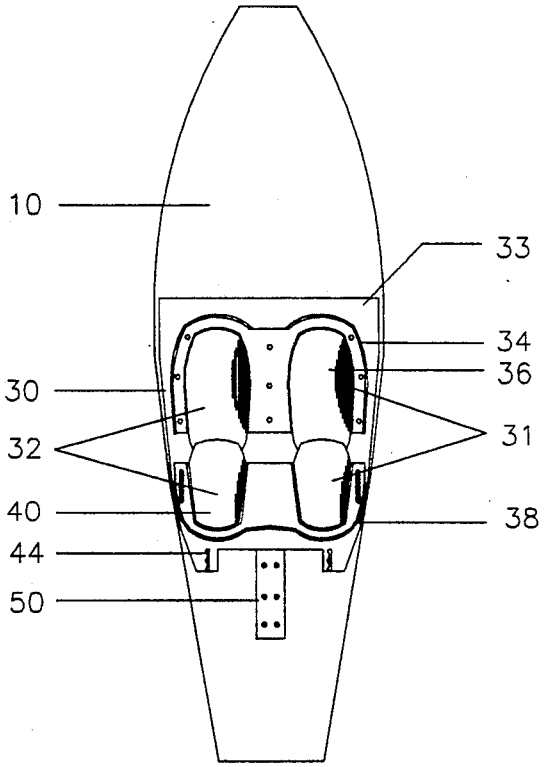
FIG. 2 is a top view showing the shape of the sides of the ski, location of the bindings, and location of fin fixing flange.
Figure 3:
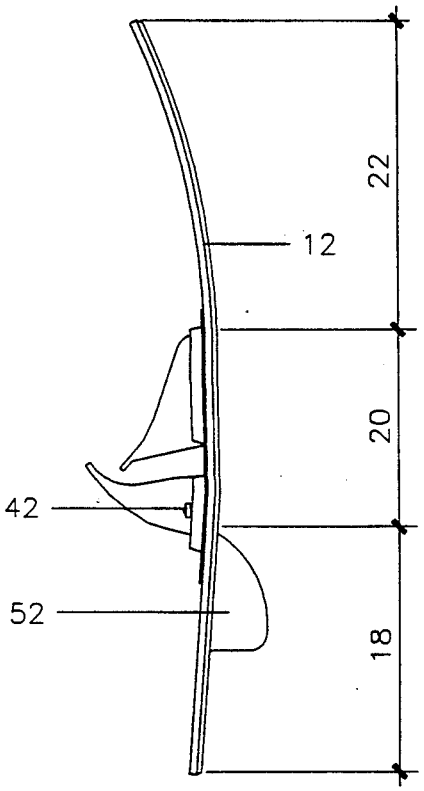
FIG. 3 is a profile of the ski showing the curvature or rocker of the ski, location of the bindings, and location of the fin and location of the fin fixing flange.

A typical embodiment of the water ski of the present invention is illustrated in FIG. 1 (perspective view of the top of the ski). The water ski includes an elongated ski body 10 and a side by side binding 30 and fin fixing flange 50 which secures the fin 52 in place. In FIG. 3 the ski body profile is indicated with a upturned forebody 22 or forebody rocker. The radius of the rocker at the very tip of the ski is approximately 15 inches and approximately 100 inches at the transition of the forebody and the midbody 20. The midbody is characterized by a slight radius or rocker of approximately 200 inches. The transition from the midbody 20 to the tail 18 is an angle of 1 to 3 degrees and continues either in a straight or slightly radiussed line to the end of the tail. FIG. 2 is a top view of the ski showing the shape of the sides of the forebody, midbody, and tail. The forebody is approximately 2 inches wide at its end and approximately 12 inches wide where it meets the midbody 20. The midbody 20 is approximately 12 inches wide where it meets the forebody and tapers to approximately 10 inches at the start of the tail 18. The tail 18 tapers to approximately 5 inches at its end.

The binding 30 shown on FIG. 2 is mounted at the rear of the midbody 20 approximately 11 to 13 inches from the end of the tail 18 and is centered on the longitudinal axis of the ski body 10. The binding 30 consists of a right 31 and left boot 32 and is mounted side by side on the binding plate 33 which is attached to the ski body 10 with screws. The binding plate 33 can be moved forward or backward along the longitudinal axis of the ski body 10 by loosening the screws and sliding the binding plate 33. The binding heal clamp 38 is adjustable either toward or away from the arch clamp 34 assembly. The heal, arch clamps, and the binding plate are made of either plastic or metal. The heal cup 40 and toe piece 36 are made of rubber.

FIGS. 2 and 3 show the fin fixing flange 50 and the fin 52. The fin fixing flange 50 is a integral part of the fin 52 and is attached to the body of the ski with screws. The transverse center of the fin 52 is located 2 to 3 inches behind the heal clamp 38 of the binding 10. The fin 52 fits through a slot in the ski body 10 and projects through to the underside of the ski. The fixing flange 50 fits into a recess in the top of the ski body 10 so that the binding plate may move over the fixing flange 50 during adjuxtment of the binding plate 33.

Figure 4:
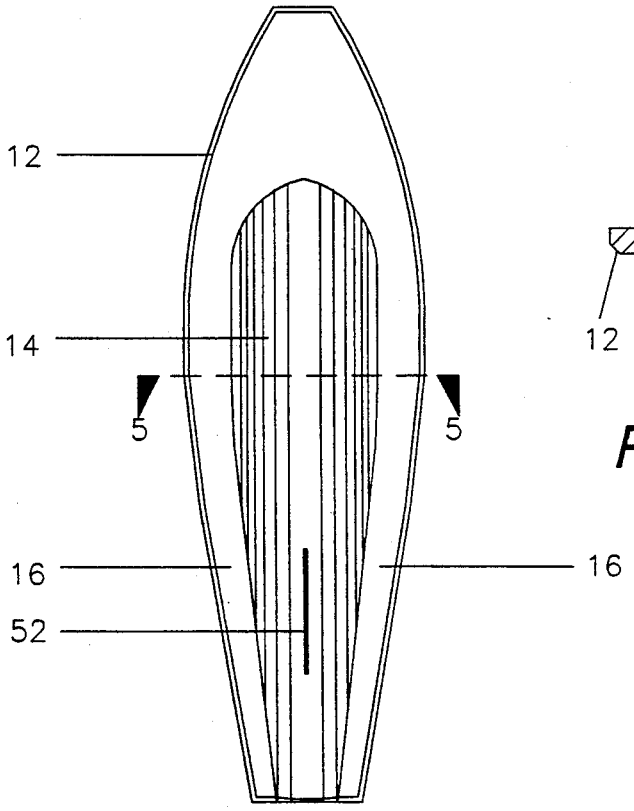
FIG. 4 is a underside view showing the shape of the sides of the ski, concave, fin location, and bevels.
Figure 5:
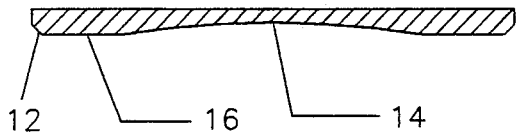
FIG. 5 is an enlarged sectional view taken along line 1—1.

The underside of the ski is shown in FIG. 4. The underside of the ski is composed of a concave tunnel 14 which begins at the tail 18 of the ski body 10 and progresses through two thirds of the skis length and ends at the forebody 22. The bottom of the ski body 10 includes bevels 12 located along the right and left sides of the ski. FIG. 4 shows the bevels at 45 degrees above horizontal. The underside of the ski also has a pair of flat rails 16 which are between the left and right side respectively between the bevel 12 and the concave tunnel 14 and extend generally parallel to the top surface of the ski and which may receive grooves or other channeling contours as shown in FIG. 5.

The ski body 10 shall be manufactured by the wet-wrap compression moulding method. The top surface shall be ABS plastic or aluminum and shall be bonded to a core of structural urethane or aluminum honeycomb. The urethane or aluminum core is wrapped with fiberglass cloth and stiffening fiber (graphite and or kevlar) and permeated with polyester resin. The bottom surface is impact resistant plastic and is bonded to the core.

OPERATION OF INVENTION

The ski is intended for use by recreational and professional water skiers of all skill levels. Because of its novel size, shape, profile, and binding configuration the ski permits a exciting and novel way of skiing of a nature not heretofore possible with conventional skis.

Specifically, the skier inserts both fee in the side by side bindings 10 which can be adjusted with the heel clamp 38 adjusting mechanism or shall be fixed in place with fixing screws to suit a skiers particular foot size. The entire binding assembly may be moved forward or backward on the ski body 10 by loosening the binding plate adjustment screws and sliding the plate in the slots and retightening the screws. Moving the binding assembly either forward or back on the skibody 10 permits different performance by shifting the skiers weight over the ski and thereby altering the angle at which the ski planes through the water. This angle is known as the angle of attack.

The function of the side by side binding configuration is to provide unique body position in which to ski whereby the legs are perpendicular to the direction of the boat travel. Also, the side by side binding in conjunction with the short length of the ski allow for faster rotation when performing aerial tricks and also permits a type of body and foot position similar to that of snow skiing.

As shown in FIG. 3 the upturned or rockered forebody 22 allows the ski to cut through the water either at high (30 mph) or low (18 mph) boat speeds. The midbody rocker 20 allows the ski to more easily transfer body weight from forward to backward when setting up to turn which is necessary since the side by side binding eliminated the inherent leverage of the end to end binding configuration. Behind the midbody 20 is the tail section 18. The tail rocker begins at the end of the midbody 20 and continues to the end of the ski. The tail rocker aids the ski in making smooth tight turns.

The bottom surface of the ski as shown in FIGS. 4 and 5 is composed of the concave tunnel 14, the rails 16, and the bevels 12. The bevels 12 assist in turning the ski by providing a transitional surface between the bottom and the side of the ski which allows the ski to roll easily into a turn and the bevels also assist in tracking (maintaining a staight line) Similarly, the concave tunnel 14 also aids the ski in turns and tracking by channeling water from the forbody 22 through the tail 18. The rails 16 are the surface on which the ski rides at slalom speeds when the ski riding flat on the water.

The overall shape of the ski as shown in FIG. 2 is characterized by a broad forebody 22 which provides lift when performing a deep water start. The midbody 20 is the area at which the ski turns about or pivots when performing slalom turns and also provides lift for wake jumping and tricks. The midbody 20 is wide in order to accomodate the side by side binding. Aft of the midbody 20 is the tapered tail section of the ski. The taper starts at the end of the mid body 20 and continues to the end of the ski. The tail taper and the narrowness of end of the tail provide quick and responsive slalom turns.

As shown in FIGS. 2 and 3 the fin 52 is located just behind the heel clamp 38 of the binding 30. The primary function of the fin 52 is to prevent the ski from side slipping or slipping out in slalom turns and to provide tracking. It is important to note that the location of the fin is just behind rotational center of the ski which is just behind the heel clamp 38. This reduces the leverage required to overcome the skis resistance to turning.

SUMMARY, RAMIFICATIONS, AND SCOPE

Accordingly, the reader will see the water ski of this invention with its unique shape, length, and side by side binding configuration provides an exciting and novel performance characteristics for enjoying the sport of water skiing.

Permits slalom turns at slower boat speeds.

Provides a trick ski which is stable at high boat speeds.

Provides a ski with a novel side by side binding configuration.

Provides for a body position which is similar to snow skiing and thus may provide a means of off-season practice for snow skiers.

Provides a exciting and new product for ski manufacturers which will stimulate sales and a larger market share.

Although the description above contains many specifications, these should not be construed as limiting the scope of the invention but as merely providing illustrations of some of the presently preferred embodiments of this invention. For example, the ski may have many different rocker profiles and or forebody, midbody, and tail shapes and tapers. In addition, the bindings may have many means of adjustment and may also be set wider apart. Also the fin may be located at many different locations along the longitudinal axis of the ski and the ski can have two fins.

Thus the scope of the invention should be determined by the appended claims and their legal equivalents, rather than by the examples given.

I claim:

1. A water ski comprising an elongated ski body having a longitudinal centerline, a bowed bottom extending subtantially the length of said ski body, said bowed bottom including a stabilizing fin, and a right and left foot binding means, wherein said right foot binding means is mounted on the right side of the longitudinal centerline of said ski body and said left foot binding means is mounted on the left side of said longitudinal centerline of said ski body, and wherein said right and left foot binding means are located at a position that is at least partially overlying said stabilizing fin.

2. The water ski of claim 1 in which said right and left binding means are a unit and said unit is attached to said ski body by a binding plate means.

3. The water ski of claim 1, wherein said right and left foot binding means further comprise a heel clamp and said stabilizing fin is affixed at the longitudinal centerline of said ski body in a position at least partially underlying the heel clamp of said binding means.

4. A water ski comprising a broad and elongated ski body having a longitudinal centerline, a bowed bottom extending substantially the length of said ski body, said bowed bottom including a stabilizing fin, and a right and left foot binding means, wherein said right foot binding means is mounted on the right side of the longitudinal centerline of said ski body and the left foot binding means is mounted on the left side of said longitudinal centerline of said ski body, and wherein said right and left foot binding means are located in a position at least partially overlying said stabilizing fin.

5. The water ski of claim 4 in which the length to width ratio of said ski body is between 3.3:1 and 4.0:1.

6. The water ski of claim 4 in which said right and left foot binding means are independent of each other and said right foot binding means is mounted on the right side of said longitudinal centerline of said ski body and said left foot binding means is mounted on the left side of said longitudinal centerline of said ski body.

7. The water ski of claim 4, wherein said right and left foot binding means further comprise a heel clamp and said stabilizing fin is affixed along said longitudinal centerline of said ski body in a position at least partially underlying the heel clamp of said foot binding.

* * * * *